US008126379B2

(12) United States Patent
Hayase et al.

(10) Patent No.: US 8,126,379 B2
(45) Date of Patent: Feb. 28, 2012

(54) DEVELOPING DEVICE AND IMAGE FORMING APPARATUS

(75) Inventors: Toru Hayase, Toyokawa (JP); Yuusuke Okuno, Toyokawa (JP); Shigeki Yamamoto, Toyokawa (JP); Kuniya Matsuura, Toyohashi (JP); Hiroshi Murasaki, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 446 days.

(21) Appl. No.: 12/480,070

(22) Filed: Jun. 8, 2009

(65) Prior Publication Data

US 2009/0311011 A1 Dec. 17, 2009

(30) Foreign Application Priority Data

Jun. 17, 2008 (JP) ..... 2008-157539

(51) Int. Cl.
*G03G 15/08* (2006.01)
*G03G 15/09* (2006.01)

(52) U.S. Cl. ..... 399/277; 399/267; 399/275

(58) Field of Classification Search ..... 399/267, 399/275, 276, 277
See application file for complete search history.

(56) References Cited

U.S. PATENT DOCUMENTS

| | | | | |
|---|---|---|---|---|
| 4,557,992 | A * | 12/1985 | Haneda et al. | 430/122.4 |
| 4,911,100 | A * | 3/1990 | Yamashita | 399/276 |
| 5,634,183 | A * | 5/1997 | Saito et al. | 399/277 |
| 6,539,192 | B2 * | 3/2003 | Hibino | 399/267 |
| 6,757,509 | B2 * | 6/2004 | Shoji et al. | 399/267 |
| 6,757,510 | B2 * | 6/2004 | Terai | 399/267 |
| 7,127,199 | B2 * | 10/2006 | Imamura et al. | 399/277 |
| 7,214,461 | B2 * | 5/2007 | Yamashita et al. | 430/122.7 |
| 7,236,728 | B2 * | 6/2007 | Noda et al. | 399/277 |
| 2004/0126147 | A1 * | 7/2004 | Kondo et al. | 399/277 |

FOREIGN PATENT DOCUMENTS

| | | | |
|---|---|---|---|
| JP | 04249266 A | * | 9/1992 |
| JP | 5-072902 A | | 3/1993 |
| JP | 06003963 A | * | 1/1994 |
| JP | 06019321 A | * | 1/1994 |

(Continued)

OTHER PUBLICATIONS

Decision of Allowance dated Aug. 31, 2010, issued in the corresponding Japanese Patent Application No. 2008-157539, and an English Translation thereof.

*Primary Examiner* — David Gray
*Assistant Examiner* — Fred L Braun
(74) *Attorney, Agent, or Firm* — Buchanan Ingersoll & Rooney PC

(57) ABSTRACT

The present invention provides a developing device which is capable of suppressing the generation of a fogging phenomenon and deposition of carrier particles to an electrostatic latent image carrier and developing the electrostatic latent image efficiently, the device includes a development sleeve and a magnet body onto which the sleeve is fitted, and using a two-component developer. An angular position which indicates the peak value of the magnetic flux density in the normal direction produced by a development pole of the magnet body is shifted downstream from the center position of the development pole in the direction of movement of the surface of a photosensitive member in a development region. The present invention also provides an image forming apparatus which can form high-quality images with reduced noise such as fogging by mounting the developing device.

20 Claims, 11 Drawing Sheets

FOREIGN PATENT DOCUMENTS

| | | | | |
|---|---|---|---|---|
| JP | 06194961 | A | * | 7/1994 |
| JP | 2000187390 | A | * | 7/2000 |
| JP | 2003195639 | A | * | 7/2003 |
| JP | 2004-046090 | | | 2/2004 |
| JP | 2004-348029 | | | 12/2004 |
| JP | 2008175878 | A | * | 7/2008 |

* cited by examiner

DEVELOPING DEVICE AND IMAGE FORMING APPARATUS

CROSS-REFERENCE TO RELATED APPLICATION

This invention is based on Japanese patent application No. 2008-157539 filed in Japan on Jun. 17, 2008, the entire content of which is hereby incorporated by reference.

BACKGROUND OF THE INVENTION

1. Field of the Invention

The present invention relates to an image forming apparatus such as a copying machine, a printer, a facsimile machine, or a multifunctional machine comprising two or more of these in combination, and especially to a developing device used for the image forming apparatus.

2. Description of Related Art

Image forming apparatuses such as copying machines, printers, facsimile machines, or multifunctional machines comprising two or more of these in combination charge the surface of an electrostatic latent image carrier by a charging device, subject the charged region to image exposure from an exposure device to form an electrostatic latent image, develop the electrostatic latent image by a developing device to form a toner image, and transfer the toner image onto a receiver object.

Herein, the "receiver object" is normally recording mediums such as recording papers in monochrome image forming apparatuses. Meanwhile, in full-color image forming apparatus and the like, when an intermediate transfer member onto which a toner image on an electrostatic latent image carrier is primarily transferred is employed, both the intermediate transfer member and the recording medium onto which the toner image is secondarily transferred from the intermediate transfer member are considered as receiver objects.

Known typical developing devices in such an image forming apparatus include those which use dry developers, and those which use liquid developers. Today, developing devices which use dry developers are common. Known developing devices which use dry developers include those which use so-called one component developers which are mainly composed of a toner, and those which use so-called two-component developer containing toner and carrier particles.

In general, developing devices which use a two-component developer comprise a fixedly disposed magnet body, and a development sleeve which is rotatably fitted onto the magnet body, forms and retains developer brushes comprising a developer containing a toner and magnetic carrier particles on the surface of the development sleeve by the magnetic force of the magnet body, transfers the developer brushes to a development region in which an electrostatic latent image formed on the surface of the electrostatic latent image carrier which is rotationally driven is developed, and the developer brushes are brought into contact with the surface of the electrostatic latent image carrier to develop the electrostatic latent image.

FIG. 19(A) shows an example of a magnet body MR and a development sleeve DS fitted onto the same in such a developing device. The magnet body MR has, as shown in FIG. 19(A) as an example, a magnetic pole group comprising N-poles and S-poles arranged annularly. Among these magnetic poles, the magnetic pole facing a development region Da' in which an electrostatic latent image is developed on an electrostatic latent image carrier (photosensitive member in the example illustrated) PC is a development pole Dp' which is mainly involved in development of the electrostatic latent image. In the example shown in FIG. 19(A), one N-pole facing the development region Da' serves as the development pole Dp'

At such a development pole Dp' composed of a single magnetic pole, the distribution of magnetic force is normally substantially symmetrical with respect to a center Dpc of the development pole Dp' as shown in FIG. 19(B) as an example.

FIG. 20(A) schematically shows examples (1) to (6) of the magnetic brushes of a developer formed on the development sleeve DS in the development region by such a development pole Dp'. In the example shown in FIG. 20(A), the direction of movement of the surface of the development sleeve DS in the development region, therefore the direction of transfer of the developer, is d1, and the direction of movement of the surface of the electrostatic latent image carrier PC in the development region is d2, which is opposite to d1.

The magnetic brushes (1) to (6) of the developer comprises carrier chains which are composed of the magnetic carrier particles Cp formed on the surface of the development sleeve DS by the magnetic pole(s) such as the development pole, and a toner t deposited to these.

As shown in FIG. 20(A), the magnetic brushes by the development pole Dp' start to be generated slightly upstream of the development region in the direction of transfer of the developer d1 in which the magnetic flux density in the direction of the tangent of the surface of the development sleeve DS is high, and are transferred downstream with the shape of the brushes maintained.

Described in further details, a magnetic brush starts to rise up in a portion adjacent downstream of the middle position between the development pole Dp' and the adjacent upstream magnetic pole (not illustrated). As shown in FIG. 20(A), a long magnetic brush (1) then rises up in the vicinity of an upstream end portion of the development region Da'. A magnetic brush (2) whose forward end portion is in contact with and bent by the image carrier PC downstream of the brush (1) starts to rub the surface of the image carrier PC. On a further downstream side, the bent portions of the brushes (2) become magnetic brushes (3), (4) and (5) which have been reduced in length but increased in thickness in a manner of being folded, and rub the surface of the image carrier PC. A magnetic brush (6) which remains short and thick is detached from the image carrier PC near the downstream end of the development region Da'.

In development of the electrostatic latent image by the magnetic brushes formed in such a manner, as schematically shown in FIG. 20(B), the forward end portions of long magnetic brushes (21), (22) as the magnetic brush (1) of FIG. 20(A) are likely to act in a manner of scraping off the toner t deposited to the electrostatic latent image. When a large amount of the toner t deposited to the electrostatic latent image is scraped off, image deficiency occurs and image density is lowered, whereby the image quality is lowered.

As schematically shown in FIG. 20(C), in a thick and short magnetic brush (40) such as the magnetic brushes (3) to (6) in FIG. 20(A), the degree of freedom of the toner t in the brushes is likely to be lost, and its contribution to the development is likely to be difficult. When the degree of freedom of the toner t is lost and the amount of the toner deposited to the electrostatic latent image is reduced, development efficiency is lowered, image deficiency occurs, and image density is lowered, which lowers the image quality.

Generally speaking, when a developing device in which the development pole is constituted by a single pole is used by being mounted on an image forming apparatus with high processing speed (the rate of image formation process), there is a known tendency of lowered development performance. In particular, there is a tendency that the carrier particles are deteriorated by a change in their surface shapes in image formation, deposition of toner resin components and for other reasons, and accordingly the amount of the developer transferred by the magnet body and development sleeve is reduced, and the density of the toner image which is developed and formed is reduced.

Japanese unexamined Patent Publication No. H5-72902 (JP, 05-72902, A) describes that in order to solve such a problem, the development pole facing the development region is rendered a same-polarity development pole which is magnetized so as to have adjacent poles having the same polarity.

FIG. 21(A) shows an example of the distribution of magnetic force by a so-called same-polarity development pole in which adjacent poles having the same polarity (N-poles or S-poles) have been magnetized. FIG. 21(B) shows an example of the magnetic flux density of a portion containing the development pole of a magnet body having a same-polarity development pole. In FIG. 21(B), Br is the magnetic flux density in the normal direction with respect to the surface of the development sleeve, and BO is the magnetic flux density in the direction of a tangent of the surface of the development sleeve. f shows the magnetic attraction force ($f=Br+B\theta$).

In FIG. 21(B), the central angular position on the magnet body shown on the horizontal axis is a position corresponding to the angular amount (referring to FIG. 2, the central angle amount of revolution in the counterclockwise direction in FIG. 2), with reference to the central position of a so-called D cut face (D cut face Dc as shown in FIG. 2 described later) for positioning and fixing the magnet body formed at an end portion of the shaft of the magnet body. In the example shown in FIG. 21(B), the angular position of the center of the development pole is a position mp which is 290 degrees from the reference position in the counterclockwise direction.

As can be seen from FIG. 21(B), when the same-polarity development pole is employed, the magnetic force f is abruptly reduced between the adjacent same-polarity portions, which lowers the magnetic attraction force and causes the disturbance of the developer. Therefore, the toner is rendered more mobile in this portion proportionally, and the developability of the electrostatic latent image is improved proportionally. Normally, the generation of stripe-like image noise which may occur when there is clogging in a controlling member (brush height controlling member) which controls the height of the developer brushes provided upstream of the development region in the direction of rotation of the development sleeve is advantageously suppressed by the disturbance of the developer resulting from a decrease in the magnetic constraining force. Furthermore, the contact resistance of the developer to the electrostatic latent image carrier in the development region is reduced because of a repulsive magnetic field caused by the adjacent magnetized portions having the same polarity, and therefore the disturbance in the image is proportionally suppressed, and the image quality is advantageously improved.

However, in a developing device which employs the same-polarity development pole, the magnetic force is abruptly lowered in the central portion between adjacent magnetized portions having the same polarity. Therefore, the amount of toner scattering is large in the portion of the development region corresponding to the central portion, and the image is thus likely to have fogging.

Setting the central portion between the same-polarity magnetized portions in a position where the developer leaves the electrostatic latent image carrier in order to suppress the fogging phenomenon by quickly removing the central portion between the same-polarity magnetized portions away from the electrostatic latent image carrier causes the carrier particles to be easily deposited to the electrostatic latent image carrier due to the disturbance of the developer resulting from a decrease in the magnetic force in the central portion.

SUMMARY OF THE INVENTION

A first object of the present invention is to provide a developing device which comprises a fixedly disposed magnet body, and a development sleeve which is rotatably fitted onto the magnet body, the developing device forming and retaining developer brushes comprising a developer containing a toner and magnetic carrier particles on the surface of the development sleeve by the magnetic force of the magnet body, transferring the developer brushes to a development region in which an electrostatic latent image formed on a surface of an electrostatic latent image carrier which is rotationally driven is developed, and bringing the developer brushes into contact with the surface of the electrostatic latent image carrier to develop the electrostatic latent image, and the developing device being capable of suppressing the generation of a fogging phenomenon, suppressing a deposition of the carrier particles to the electrostatic latent image carrier more than in the case where the central portion between the same-polarity magnetized portions in the same-polarity development pole is set to a position where the developer leaves the electrostatic latent image carrier, and developing the electrostatic latent image efficiently.

A second object of the present invention is to provide an image forming apparatus wherein an electrostatic latent image formed on the electrostatic latent image carrier which is rotationally driven can be developed to form a toner image by the developing device, and an image thus having a high quality with suppressed image noises such as fogging can be formed.

The inventors of the present invention have conducted extensive research to achieve the above-mentioned objects, and addressed the following points.

(a) Assuming that the development pole is of the same-polarity development pole, the magnetic force between the adjacent pole portions magnetized to have the same polarity is abruptly reduced, and accordingly the disturbance of the developer occurs and the amount of the toner scattering is increased, whereby image fogging is more likely to be generated.

(b) Therefore, it can be considered that in order to prevent the disturbance which causes such fogging phenomenon of the developer, the development pole is preferably a single magnetic pole.

(c) However, when the development pole is formed from a single magnetic pole, rendering the distribution of the magnetic force of the development pole substantially symmetrical with respect to the center of the development pole as shown in FIG. 19(B) causes formation of magnetic brushes which become shorter and thicker toward downstream in the direction of transfer of the developer, as already mentioned. The degree of freedom of the toner t is lost by the development with the thick and short magnetic brushes, and the efficiency of development is lowered.

The inventors of the present invention have conducted further extensive research, and found the followings to form the development pole from a single magnetic pole, and improve the efficiency of development at the same time.

(d) A position in the magnet body (angular position) which show the peak value of the magnetic flux density by the development pole in the normal direction with respect to the surface of the development sleeve is shifted downstream in the direction of movement of the surface of the electrostatic latent image carrier in the development region from the center position of the development pole.

(e) The angular positions in the magnet body which show the magnetic flux density of the predetermined proportion of the peak value of the magnetic flux density (for example, 50% of the peak value) are to be positions which are spaced at equal angular intervals upstream and downstream in the direction of movement of the surface of the electrostatic latent image carrier from the angular position which indicates the peak value of the magnetic flux density.

(f) Furthermore, the relationship Y>X is to be held between a central angle X from the angular position in the magnet body which indicates the peak value of the magnetic flux density to the position which is on the downstream side and in which the magnetic flux density in the normal direction becomes 0 in the direction of movement of the surface of the electrostatic latent image carrier and a central angle Y from the angular position indicating the peak value to the position which is on the upstream side and in which the magnetic flux density in the normal direction becomes 0.

Under these conditions, distribution of lines of magnetic force in an upstream portion of the development pole (a portion of the development pole including the upstream end of the development pole near the upstream side) in the direction of movement of the surface of the electrostatic latent image carrier in the development region is constituted in a proportion smaller in number of magnetic force lines than distribution of lines of magnetic force by a portion near the downstream side. However, the direction of the lines of magnetic force by the upstream portion remains the same or substantially the same as the direction of lines of magnetic force in the upstream portion when the position which indicates the peak value of the magnetic flux density in the normal direction is not shifted downstream in the direction of movement of the surface of the electrostatic latent image carrier (in other words, the direction of lines of magnetic force does not change or hardly changes). In this manner, the magnitude of the vector of the magnetic force in the upstream portion can be reduced in a state that the direction of lines of magnetic force remains the same or substantially the same. Accordingly, couple (couple of forces) (couple of forces produced by a magnetic force component perpendicular to the magnetic field vector) can be exerted on the magnetic brushes (in particular on the carrier particle chains in the brushes) to cause the brushes to stand upright on the surface of the development sleeve. This helps the magnetic brushes produced by the upstream portion to rub the electrostatic latent image carrier proportionally easily.

Moreover, the upstream portion of the development pole in which the magnitude of the magnetic force vector has been reduced in such a manner can be set over a large width in the development pole in the direction of transfer of the developer, and the developer facing the upstream portion with decreased magnitude of the magnetic force vector over a large width can be retained on the development sleeve in the form of a number of thin magnetic brushes with low magnetic force, and therefore in a state that the mobility of the carrier particles is increased. The force for constraining the toner in those magnetic brushes is lower than those of known thick and short magnetic brushes as shown exemplarily in FIG. 20(C), and the transference of the toner to the electrostatic latent image is made proportionally easier.

Hence, compared to the case where the development pole is formed of a single magnetic pole and the distribution of the magnetic force of the development pole is made substantially symmetrical with respect to the center of the development pole as shown in FIG. 19(B), the efficiency of development can be improved.

In addition, since the development pole consisting of a single magnetic pole is employed, the generation of the fogging phenomenon can be suppressed better than in case where the same-polarity development pole is employed, and at the same time, deposition of the carrier particles to the electrostatic latent image carrier can be suppressed better than in the case where the central portion between the same-polarity magnetized portions in the same-polarity development pole is set to a position where the developer leaves the electrostatic latent image carrier, thereby improving the efficiency of development.

Described more specifically regarding the suppression of the deposition of the carrier particles to the electrostatic latent image carrier, by employing the development pole consisting of a single magnetic pole, and by shifting the position which indicates the peak value of the magnetic flux density in the normal direction in the development pole from the center position of the development pole (where the development sleeve comes closest to the electrostatic latent image carrier normally) downstream in the direction of movement of the surface of the electrostatic latent image carrier in the development region, the highest magnetic force can be exerted on the very point where the developer leaves the electrostatic latent image carrier, so that deposition of the carrier to the electrostatic latent image carrier can be suppressed.

Based on such findings, the present invention provides the following developing device to achieve the first object, and provides the following image forming apparatus to achieve the second object.

(1) Developing Device

A developing device comprising a fixedly disposed magnet body, and a development sleeve which is rotatably fitted onto the magnet body, the developing device forming and retaining developer brushes comprising a developer containing a toner and magnetic carrier particles on a surface of a development sleeve by a magnetic force of the magnet body, transferring the developer brushes to a development region in which an electrostatic latent image formed on a surface of an electrostatic latent image carrier which is rotationally driven is developed, and bringing the developer brushes into contact with the surface of the electrostatic latent image carrier to develop the electrostatic latent image, wherein the magnet body has a group of annularly arranged magnetic poles comprising a development pole which is a single magnetic pole facing the development region, an angular position which indicates a peak value of a magnetic flux density produced by the development pole in a normal direction with respect to the surface of the development sleeve in the magnet body is shifted downstream of an angular position of the center of the development pole in the magnet body in the development region in a direction of movement of the surface of the electrostatic latent image carrier opposing the development sleeve, the angular positions which indicate a magnetic flux density of predetermined proportion of the peak value of the magnetic flux density in the magnet body are positions which are spaced at an equal angular intervals upstream and downstream in the direction of movement of the surface of the electrostatic latent image carrier (the equal angular intervals include approximately equal angular intervals which can be considered as equal intervals.), and the relationship between an angle X from the angular position in the magnet body which indicates the peak value of the magnetic flux density to a position which is downstream of the angular position indicating the peak value and in which the magnetic flux density in the normal direction becomes 0 in the direction of movement of the surface of the electrostatic latent image carrier and an angle Y from the angular position indicating the peak value to a position which is upstream of the angular position indicating the peak value and in which the magnetic flux density in the normal direction becomes 0 is Y>X.

(2) Image Forming Apparatus

An image forming apparatus comprising a developing device according to the present invention, and being capable of developing an electrostatic latent image formed on an electrostatic latent image carrier which is rotationally driven and forming a toner image by the developing device.

The foregoing and other objects, features, aspects and advantages of the present invention will become more apparent from the following detailed description of the present invention when taken in conjunction with accompanying drawings.

DESCRIPTION OF THE PREFERRED EMBODIMENTS

Examples of the image forming apparatus according to the present invention and developing devices used therein will be described below with reference to drawings.

Figure 1:
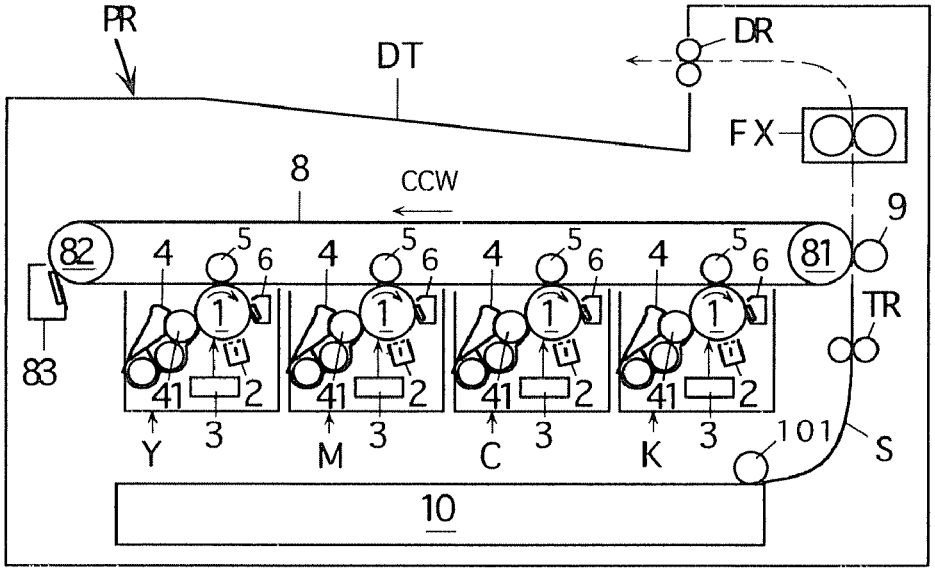
FIG. 1 is a drawing which shows an outline of the constitution of an example of the image forming apparatus according to the present invention.

FIG. 1 shows the outline of the constitution of an example PR of an image forming apparatus. The image forming apparatus PR is a tandem-type full-color printer.

This printer PR has an endless intermediate transfer belt 8 which is wound on a drive roller 81 and an opposing roller 82. The transfer belt 8 is driven by the drive roller 81 driven by a belt drive unit, which is not illustrated, in the counterclockwise direction (the direction of the arrow in the figure) CCW in the figure.

A cleaning device 83 for cleaning toners and the like remaining from the secondary transcription of a toner image on the transfer belt 8 faces the roller 82, and a secondary transfer roller 9 faces the drive roller 81. Toners and the like collected by the cleaning device 83 are transferred to a waste container by a transfer means, which is not illustrated.

The surface layer portion of the secondary transfer roller 9 is formed from an elastic material; is pressed against a portion of the intermediate transfer belt 8 supported by the drive roller 81 by a pressing means, which is not illustrated; forms a nipping portion between itself and the intermediate transfer belt 8; and can be rotated by the rotation of the intermediate transfer belt 8, and(or), as will be described later, by the movement of a recording medium S transferred to the nipping portion. A secondary transfer bias can be applied to the secondary transfer roller 9 from a power supply, which is not illustrated.

A fixing apparatus FX is disposed above the intermediate transfer belt 8 and secondary transfer roller 9, and a pair of timing rollers TR is disposed therebelow. Further below the rollers, a cassette 10 for accommodating recording mediums such as recording papers S is disposed.

The fixing apparatus FX comprises a fixing and heating roller which has a heat source such as a halogen lamp heater and the like incorporated therein and a pressure roller which is pressed against this roller.

The recording medium S contained in the cassette 10 can be supplied sheet by sheet to the pair of timing rollers TR by being withdrawn by a medium supply roller 101.

Between the rollers 81, 82 on which the intermediate transfer belt 8 is wound, from the roller 82 to the roller 81 along the transfer belt 8, a yellow image forming portion Y, a magenta image forming portion M, a cyan image forming portion C and a black image forming portion K are disposed in the order stated.

Each of the image forming portions Y, M, C, K comprises a drum-shaped photosensitive member 1 as an electrostatic latent image carrier, and a charging device 2, an exposure device 3, a developing device 4, a primary transfer roller 5 and a cleaning device 6 are disposed around the photosensitive member in the order stated.

The primary transfer roller 5 opposes the photosensitive member 1 with the transfer belt 8 interposed therebetween, and is rotated by the traveling of the belt 8. A primary transfer bias for primarily transferring the toner image formed on the photosensitive member 1 to the belt 8 can be applied to the primary transfer roller 5 from a power supply which is not illustrated.

The exposure device 3 can carry out image exposure on the photosensitive member 1 by dot exposure by the flashing of a laser beam depending on image information provided from a personal computer or the like, which is not illustrated.

The photosensitive member 1 in each image forming portion herein is a negatively chargeable photosensitive member, and can be rotationally driven by a photosensitive member drive motor, which is not illustrated, in the clockwise direction in the figure.

The charging device 2 in each image forming portion in this example is a scorotron charger, and a voltage for charging is applied at a predetermined timing from a power supply, which is not illustrated. The charging device 2 may be also one that uses a charging roller or the like.

Figure 2:
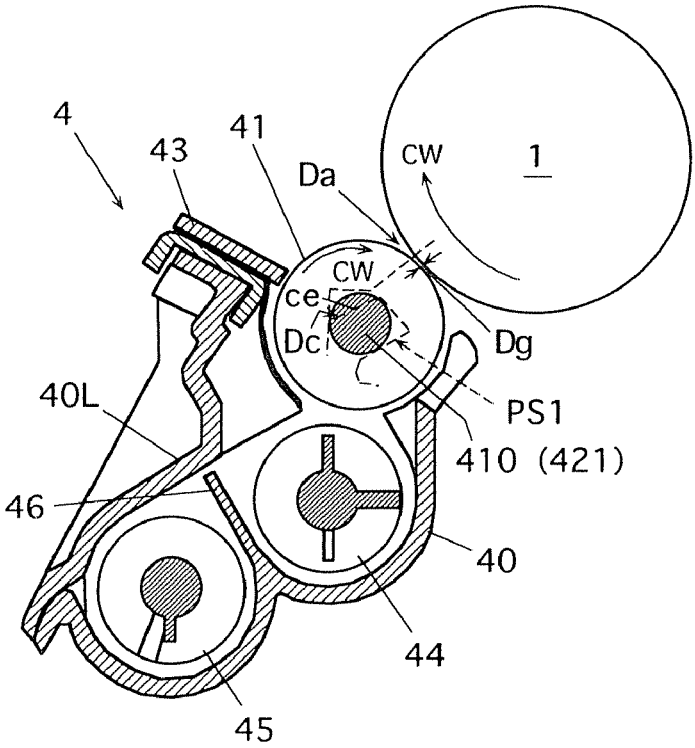
FIG. 2 is a drawing which shows an outline of a cross sectional structure of the developing device in the image forming apparatus of FIG. 1.

The developing device 4 in each image forming portion is also shown in FIG. 2, and the electrostatic latent image formed on the photosensitive member 1 can be reversely developed by a roller-shaped development sleeve (in other words, developing roller) 41 to which a development bias is applied from a power supply, which is not illustrated, by using a so-called two-component developer which comprises a magnetic carrier and a negatively chargeable toner as main ingredients. The developing device 4 will be described later in further details.

This printer can form an image by using one or more of the Y, M, C, K image forming portions.

Taking as an example the case where a full-color image is formed by using all of the image forming portions Y, M, C and K, first, a yellow toner image is formed in the yellow image forming portion Y, and this image is primarily transferred onto the transfer belt 8.

That is, in the yellow image forming portion Y, the photosensitive member 1 is rotationally driven in the clockwise direction in the figure; its surface is uniformly charged to have a predetermined potential by the charging device 2; the charged region is subjected to image exposure for yellow image by the exposure device 3; and an electrostatic latent image for yellow is formed on the photosensitive member 1. This electrostatic latent image becomes a visible yellow toner image by being developed at the development sleeve 41 of the developing device 4 having a yellow toner to which the development bias is applied. The yellow toner image is primarily transferred onto the transfer belt 8 by the primary transfer roller 5. At this time, a primary transfer bias is applied to the primary transfer roller 5 from a power supply, which is not illustrated.

Likewise, a magenta toner image is formed in the magenta image forming portion M and transferred onto the transfer belt 8; a cyan toner image is formed in the cyan image forming portion C and transferred onto the transfer belt 8; and a black toner image is formed in the black image forming portion K and is transferred onto the transfer belt 8.

The yellow, magenta, cyan and black toner images are formed at a time at which these are transferred onto the intermediate transfer belt 8 over one another.

The multiple-toner image thus formed on the transfer belt 8 moves toward the secondary transfer roller 9 by the rotation of the transfer belt 8.

Meanwhile, the recording medium S is withdrawn from the cassette 10 for accommodating recording media by the medium supply roller 101, and is supplied to the pair of timing rollers TR to wait there.

The recording medium S which waits at the pair of timing rollers TR in this manner is supplied to the nipping portion between the transfer belt 8 and the secondary transfer roller 9 simultaneously with the transference of the multiple-toner image transferred by the intermediate transfer belt 8. The multiple-toner image is secondarily transferred onto the recording medium S by the secondary transfer roller 9 to which a secondary transfer bias is applied from a power supply, which is not illustrated. The recording medium S is then passed through the fixing apparatus FX, in which the multiple-toner image is fixed on the recording medium S with heating and under pressure.

The recording medium S is successively discharged onto a discharge tray DT by a pair of discharge rollers DR.

Toner residues and the like remaining from the transference on the photosensitive member 1 in the primary transfer of the toner image to the belt 8 is cleaned by the cleaning device 6, and toners and the like remaining on the belt 8 from the secondary transcription in the secondary transfer are cleaned by the cleaning device 83. Such cleaned and removed toners are transferred to the waste container, which is not illustrated, by the transfer means.

In the image formation conducted as described above, the developing device 4 which uses a two-component developer will be further described. The developing device of a preferred embodiment of the present invention basically comprise a fixedly disposed magnet body, and a development sleeve rotatably fitted onto the magnet body, and is a developing device which forms and retains developer brushes (magnetic brushes) comprising a developer containing a toner and magnetic carrier particles by the magnetic force of the magnet body on the surface of the development sleeve, transfers the developer brushes to a development region where an electrostatic latent image formed on the surface of the electrostatic latent image carrier (drum photosensitive member herein) which is rotationally driven is developed, and brings the developer brushes into contact with the surface of the image carrier to develop the electrostatic latent image.

Figure 3A:
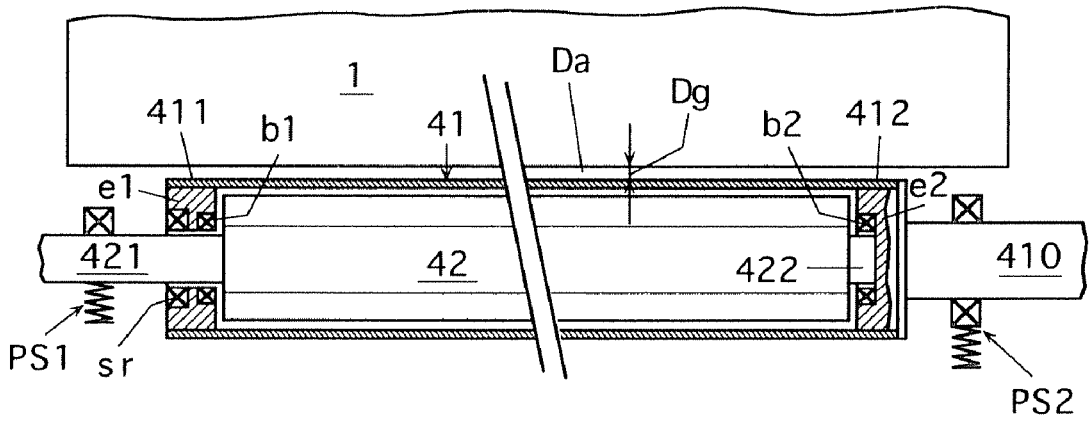
FIG. 3(A) is a drawing which show the relationship between the development sleeve of the developing device of FIG. 2 and the magnet body and the like and the positional relationship between the development sleeve and the photosensitive member.
Figure 3B:
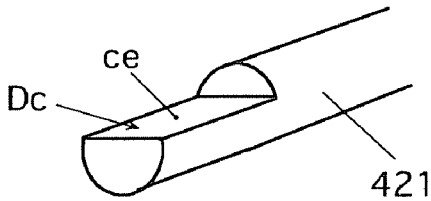
FIG. 3(B) is a perspective view which shows a D cut face of the shaft portion of the magnet body.
Figure 4:
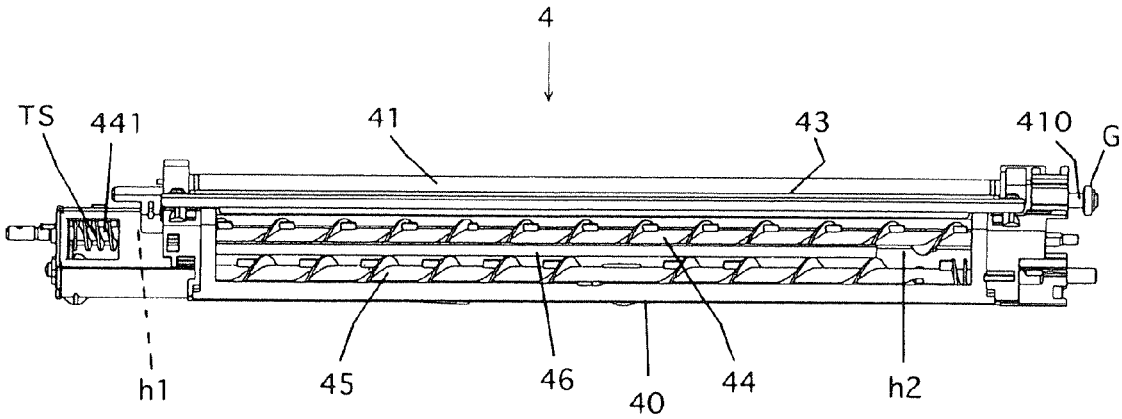
FIG. 4 is a drawing of the developing device of FIG. 2 seen from the left side in FIG. 2, with a case cover removed therefrom.
Figure 5:
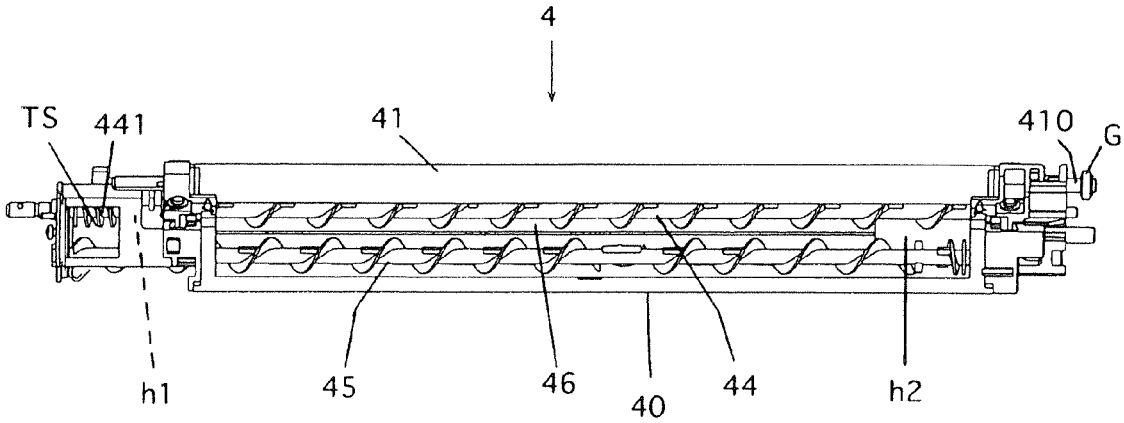
FIG. 5 is a drawing of the developing device shown in FIG. 2 seen from above in FIG. 2, with the case cover and a developer controlling member omitted.
Figure 6:
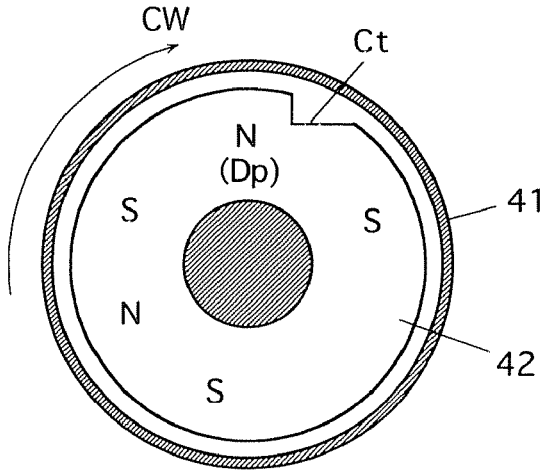
FIG. 6 is a cross-sectional view of the development sleeve and the magnet body.

The developing device 4 used herein is that shown in FIGS. 2 to 6. FIG. 2 shows the outline of a cross sectional structure of the developing device 4. FIG. 3(A) shows the relationship between the development sleeve 41 of the developing device 4 and the magnet body 42 and others and the positional relationship between the development sleeve 41 and the photosensitive member 1. FIG. 4 is a drawing which shows the developing device 4 seen from the left side in FIG. 2 with a case cover 40L removed. FIG. 5 is a drawing which shows the developing device 4 seen from above in FIG. 2, with the cover 40L and a developer controlling member 43 omitted. FIG. 6 shows cross sections of the development sleeve 41 and magnet body 42.

The developing device 4 has the development sleeve 41. The development sleeve 41 is a sleeve which is in the form of a hollow roller having a circular cross section, which is fitted onto the magnet body 42, and is rotatably supported on the magnet body 42 via left and right bearing portions b1, b2. The magnet body 42 is formed in an approximately a roller form herein.

The development sleeve 41 has a disk-shaped end member e1 fitted to a left end portion 411 in FIG. 3(A), and has a disk-shaped end member e2 fitted to a right end portion 412 in FIG. 3(A). The magnet body 42 has a shaft portion 421 protruding from the left end toward the outside of the development sleeve 41 in FIG. 3(A), and also has a shaft portion 422 protruding for a short length from the right end toward the opposite side.

The shaft portion 421 protruding from the development sleeve 41 of the magnet body 42 is supported by a developing device case 40 (refer to FIG. 2), which causes the magnet body 42 to be in a constant position with respect to the developing device case 40.

A stepped dent portion is formed on the inner face side of the left end member e1 of the development sleeve 41. The left bearing portion b1 is inserted into the dented portion and fitted onto the shaft portion 421 of the magnet body 42. A stepped dent portion is also formed on the inner face side of the right end member e2 of the development sleeve 41. The right bearing portion b2 is inserted into the dented portion and fitted onto the short shaft portion 422 of the magnet body 42.

In this manner, the development sleeve 41 is fitted onto the magnet body 42, and is made rotatable with respect to the magnet body via the left and right bearing portions b1, b2.

A stepped dent portion is also formed on the outer face side of the left end member e1 of the development sleeve 41. A seal ring sr is inserted into the dented portion and fitted onto the shaft portion 421 of the magnet body 42.

A shaft portion 410 for rotationally driving the development sleeve 41 is integrally protruding from the right end member e2 of the development sleeve 41. The shaft portion is supported by a bearing portion, which is not illustrated, rotatably relatively to the developing device case 40, and a drive gear G (refer to FIGS. 4 and 5 described later) is fitted to the end portion protruding out of the case 40. The drive gear G is driven by a developing device drive unit, which is not illustrated in the drawings, whereby the development sleeve 41 is rotationally driven in the clockwise direction CW in FIG. 2.

When the development sleeve 41 is rotationally driven about the magnet body 42, the magnet body 42 has the N-poles and S-poles alternately along the circumferential direction of the magnet body so that magnetic brushes (developer brushes) composed of the developer used in the developing device 4 are formed on the circumferential surface of the development sleeve 41. The magnet body 42 will be described later in further details.

Thus, the developing device 4 can transfer the magnetic brushes comprising the developer containing the magnetic carrier particles and toner on the circumferential surface of the development sleeve 41 to the development region Da where the electrostatic latent image on the photosensitive member is developed. The developing device 4 is also designed to control, during the transfer of the developer, the amount of the developer (the height of the magnetic brushes) transferred to the development region Da, to such an amount that is predetermined by the developer controlling member (member for controlling the height of the developer brushes) 43.

In the development region Da, the magnetic brushes arrive at a gap (development gap) Dg between the photosensitive member 1 and development sleeve 41 so that the electrostatic latent image on the photosensitive member 1 is developed, and therefore a visible toner image is formed. This toner image is transferred from the photosensitive member 1 to a receiver object (the belt 8 herein).

The development gap Dg in the development region is ensured in the following manner herein.

As shown in FIGS. 2 and 3(A), the shaft portion 421 of the magnet body 42 is inserted into and supported by a shaft portion positioning apparatus PS1 provided on a component, which is not illustrated, which supports the photosensitive member 1, and the drive shaft portion 410 of the development sleeve 41 is inserted into and supported by a shaft portion positioning apparatus PS2 provided on a component, which is not illustrated, which supports the photosensitive member 1. Thus, the development sleeve 41 is provided fixedly in a constant position with respect to the photosensitive member 1, and faces the photosensitive member 1 across the determined development gap Dg.

It should be noted that in FIG. 3(A), the shaft portion positioning apparatus PS1 is shown simply. However, the apparatus PS1 is for bringing a positioning spring into contact with a so-called D cut face Dc formed by cutting part of the end portion of the shaft portion 421 flatly in parallel to the center line of the shaft portion in such a manner that its cross section becomes D-shaped as shown in FIGS. 2 and 3(B) to form the D cut face Dc. The position of each magnetic pole in the magnet body 42 is an angular position corresponding to the amount of an angle to reach the magnetic pole in the counterclockwise direction in FIG. 2 with reference to the center ce in the circumferential direction of the shaft portion of the D cut face Dc.

A technique for setting the development gap between the photosensitive member 1 and development sleeve 41 may be that which employs the shaft portion positioning apparatuses PS1, PS2 as mentioned above, as well as that which employs rollers.

Figure 7:
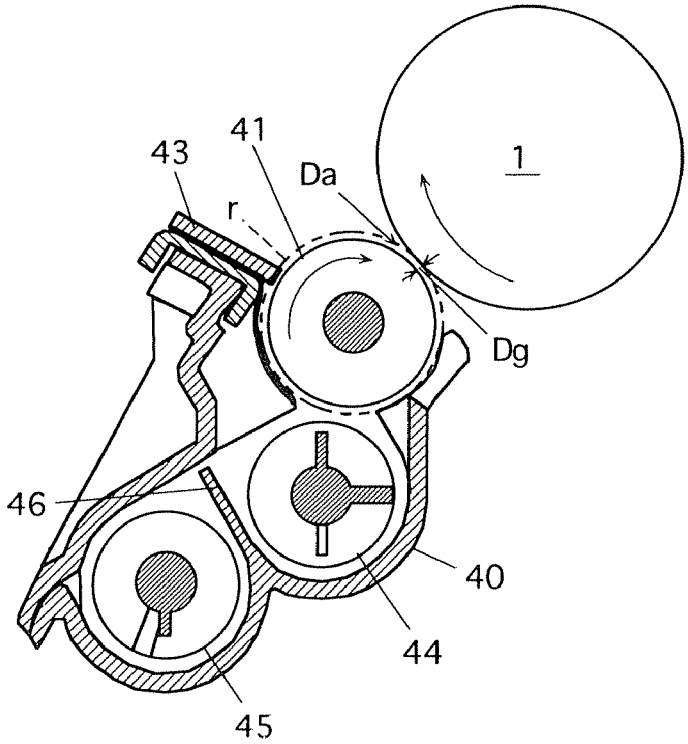
FIG. 7 is a drawing which shows another example of a development gap formation technique.

For example, as shown in FIG. 7, by inserting a roller r at the shaft portion of the development sleeve, the roller r having a diameter larger than the developing sleeve 41 by two times of the development gap Dg, and urging the entire developing device toward the photosensitive member side, or urging the development sleeve 41 toward the photosensitive member side along a guide, the roller r may be brought into contact with the circumferential surface of the photosensitive member 1 to obtain the development gap Dg.

The developing device 4 comprises, in addition to the development sleeve 41 and other components described above, a supply screw 44 which agitates and supplies the developer to the development sleeve 41 at the same time, and an agitation screw 45 which agitates the developer as well as the supply screw 44. A partition 46 is provided between the screws 44 and 45. The partition 46 has a developer circulation opening h1 (only the position of the same is shown in FIGS. 4 and 5) formed at one end thereof, and a developer circulation opening h2 formed at the other end thereof.

The screws 44, 45 are rotationally driven by a drive motor (or the above-mentioned development sleeve drive motor), which is not illustrated, and whereby the developer is caused to circulate inside the developing device 4. The developer within the developing device 4 is transferred to the right side in FIGS. 4 and 5 by the agitation screw 45 while the carrier and toner are agitated; pushed from the partition opening h2 to the supply screw 44 side; transferred to the left side in FIGS. 4 and 5 by the screw 44; and at that time, is uniformly supplied to each portion of the development sleeve 41 while the developer is agitated by the screw 44.

The developer which is transferred by the supply screw 44 to its outlet side without being subjected to development moves from the partition opening h1 to the agitation screw 45 side. The developer circulates within the developing device 4 in this manner.

A toner supply and provision screw 441 is coaxially connected to the supply screw 44 from its outlet side. The toner supplied from a toner supply hopper to a toner inlet TS, which are not illustrated, at a predetermined timing is transferred to the partition opening h1, and is mixed into the developer which is already within the apparatus 4 to be subjected to development.

The magnet body 42 will be further described. The magnet body 42 of the developing device 4 is that shown in FIG. 6. As the magnet body, that having a group of magnetic poles arranged annularly, including the development pole Dp which is a single-magnetic pole (for example N-pole) facing the development region Da, can be basically employed.

Figure 18A:
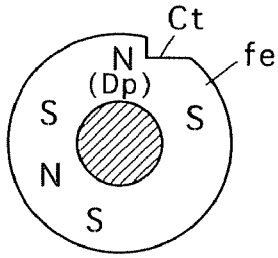
FIG. 18(A) to FIG. 18(G) are drawings which show various examples of the magnet body which can be employed.

The magnet body 42, including the development pole Dp, is entirely formed of a ferrite-based magnet. As shown in FIGS. 6 and 18(A), the development pole Dp has a cutout portion Ct to the downstream side in the direction of transfer of the developer (the same as the CW direction in FIG. 6). From a different perspective, the development pole Dp has a cutout portion Ct to the upstream side in the direction of movement of the surface of the photosensitive member 1 in the development region Da. The weight of the magnet body 42 is slightly reduced by forming the cutout portion Ct.

Figure 8:
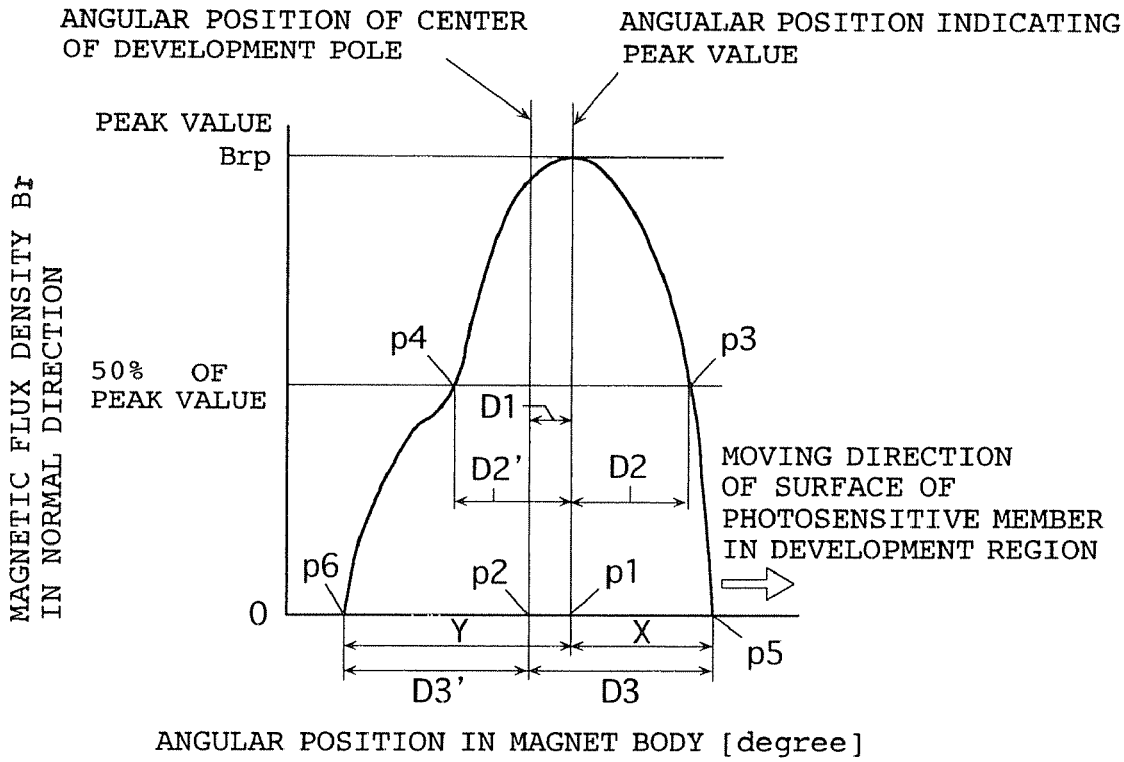
FIG. 8 is a drawing which shows an example of the distribution of the magnetic flux density of the development pole of the magnet body in the normal direction.

The development pole Dp of the magnet body 42 exhibits the distribution of magnetic flux density as shown in FIG. 8. This distribution of magnetic flux density is herein based on the premise that the development pole Dp has the cutout portion Ct.

This distribution of magnetic flux density will be described: the angular position p1 in the magnet body which indicates the peak value Brp of a density Br of magnetic flux produced by the development pole Dp in the normal direction with respect to the surface of the development sleeve 41 is shifted by a predetermined angle D1 downstream of the position p2 (angular position p2 of the center of the development pole in the magnet body) of the center of the development pole Dp, in the direction of movement of the surface of the photosensitive member 1 in the development region Da.

In this example, the center position p2 of the development pole Dp corresponds to a position in which the development sleeve 41 comes closest to the photosensitive member 1.

The angular positions p3, p4 which indicate the magnetic flux densities of a predetermined proportion of the peak value Brp of the density of magnetic flux (for example, 50% of the peak value as shown in FIG. 8) in the magnet body are positions which are spaced from the position p1 which shows the peak value of the density of magnetic flux in the direction of movement of the surface of the photosensitive member 1 upstream and downstream, respectively, by central angles D2, D2'. The angles D2 and D2' are equal central angles. Herein, the phrase "equal central angles" includes not only the case where the angles D2 and D2' are equal, but also the case where the angles D2 and D2' are similar to such a degree that can be considered as equal.

An amount of a central angle X from the position p1 in the magnet body which indicates the peak value Brp of the magnetic flux density to the position p5 where the magnetic flux density becomes 0 in the normal direction which is downstream in the direction of movement of the surface of the photosensitive member 1 and an amount of a central angle Y from the position p1 to the position p6 where the magnetic flux density becomes 0 in the normal direction which is upstream in the same direction has the relationship Y>X.

It should be noted that an angle D3 between the position p2 and the position p5 and an angle D3' between the position p2 and the position p6 are either equal or angles which can be regarded as almost equal.

In the distribution of magnetic flux density shown in FIG. 8, the change in the magnetic flux density from the angular position p1 which indicates the peak value Brp to the angular position p6 where the magnetic flux density becomes 0 which is upstream in the direction of movement of the surface of the photosensitive member 1 has a point of inflection between the angular position p4 which indicates the magnetic flux density of the above-described predetermined proportion of (for example 50% of the peak value) the peak value Brp of the magnetic flux density and the angular position p6 where the magnetic flux density becomes 0.

Figure 9:
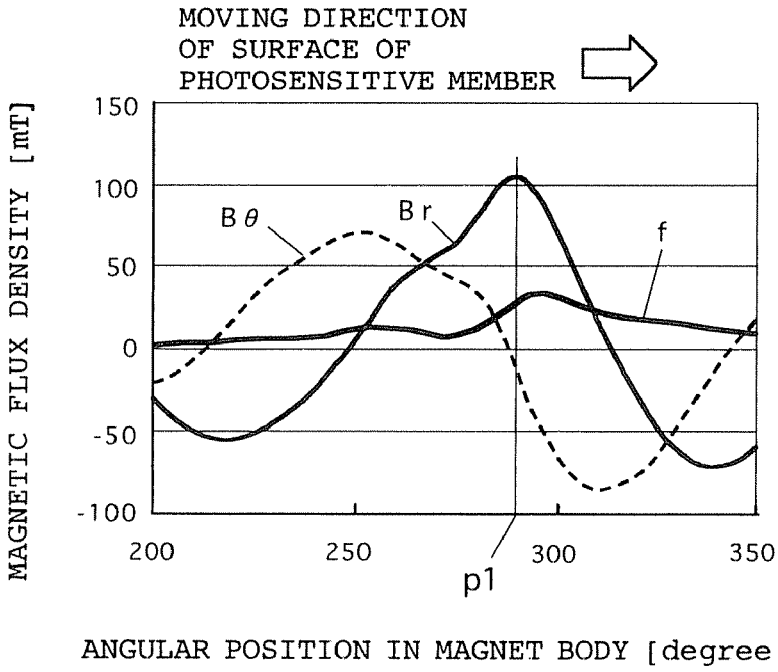
FIG. 9 is a drawing which shows an example of the distribution of the magnetic flux density of a portion containing the development pole of the magnet body in the developing device of FIG. 2.

FIG. 9 shows an example of the distribution of the magnetic flux density of a portion containing the development pole Dp of the magnet body 42. In FIG. 9, Br is the magnetic flux density in the normal direction with respect to the surface of the development sleeve 41, and Bθ is the magnetic flux density in the direction of tangent of the surface of the development sleeve 41. f shows the magnetic attraction force (f=Bθ+Br).

In FIG. 9, the angular position in the magnet body on the horizontal axis is a position which corresponds to an amount of turn of a central angle in the counterclockwise direction in FIG. 2, with reference to a widthwise central position ce of the D cut face Dc shown in FIG. 2.

Moreover, in this example, the position p1 of the peak value of the magnetic flux density produced by the development pole Dp in the normal direction is a position 290 degrees apart from the reference position ce.

Furthermore, the angular amount which corresponds to the angular amount D1 shown in FIG. 8 is about 6 degrees; the angular amount which corresponds to the angular amount D2 (D2') is about 15 degrees; and the angular amount which corresponds to angular amount D3 (D3') is about 30 degrees.

The developing device 4 has the following advantages based on the above-mentioned development pole conditions.

The distributions of lines of magnetic force (distributions of Br and BO respectively) produced by an upstream portion of the development pole Dp in the direction of movement of the surface of the photosensitive member 1 in the development region Da (a portion near the upstream side in the development pole including the upstream end of the development pole) are constituted in a proportion smaller than that of the distribution of lines of magnetic force produced by a portion on the downstream side of the development pole Dp. However, the direction of the lines of magnetic force produced by the upstream portion is equal or almost equal to the direction of lines of magnetic force in the upstream portion in a known single-pole development pole where the position which indicates the peak value of the magnetic flux density in the normal direction is not shifted downstream in the direction of movement of the surface of the photosensitive member 1 (in other words, the direction of lines of magnetic force does not change or does not substantially change). In this manner, the magnitude of the magnetic force vector in the upstream portion in the direction of movement of the surface of the photosensitive member 1 can be reduced with the direction of lines of magnetic force being the same or almost the same.

Figure 10:
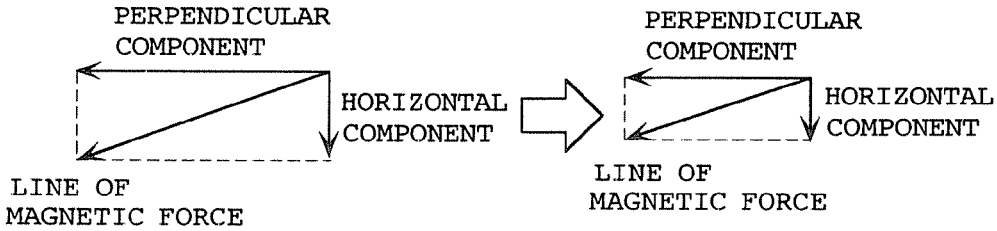
FIG. 10 is a drawing which typically shows that the magnitude of the magnetic force vector is reduced in the downstream portion while the direction of lines of magnetic force produced by the downstream portion in the development pole remains substantially the same.

FIG. 10 is a drawing which symbolically shows this. In FIG. 10, a perpendicular component is a component of the lines of magnetic force in the normal direction with respect to the surface of the development sleeve, and a horizontal component is a component of the lines of magnetic force in the direction of the tangent of the surface of the development sleeve. As shown in FIG. 10, in an upstream portion in the development pole Dp (an upstream portion in the direction of movement of the surface of the photosensitive member 1), the magnitude of the vector of the magnetic force can be reduced (refer to the right drawing in FIG. 10), while the direction of lines of magnetic force remains the same or almost the same as in the case of a known single-pole development magnetic pole (refer to the left drawing in FIG. 10).

Figure 11:
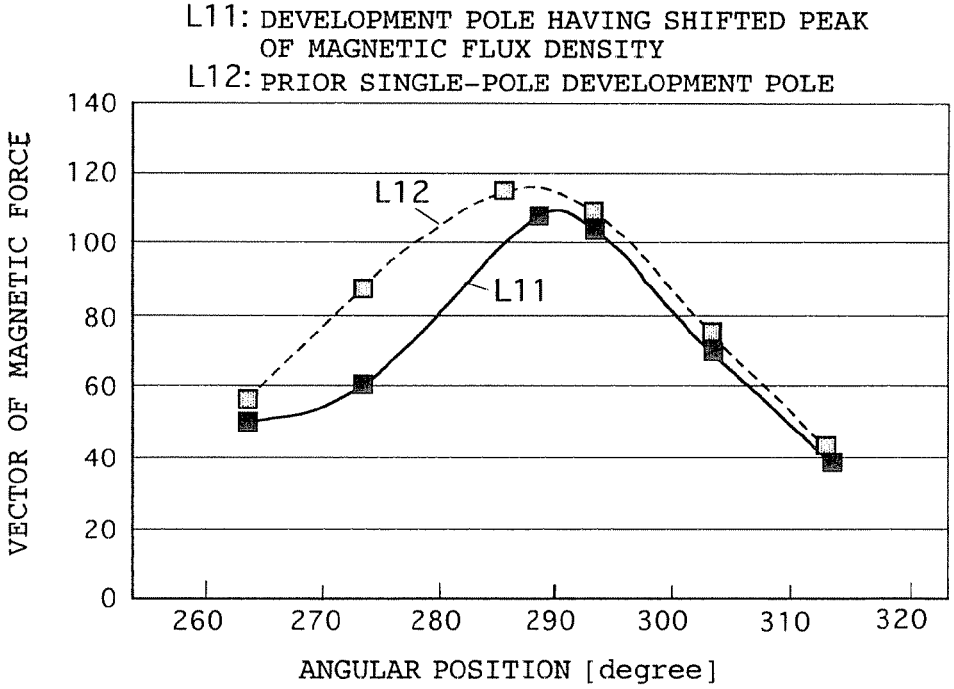
FIG. 11 is a drawing which shows an example of the changes in the magnetic force vectors produced by a known single-pole development pole and the development pole of the magnet body of the developing device of FIG. 2, respectively.
Figure 12:
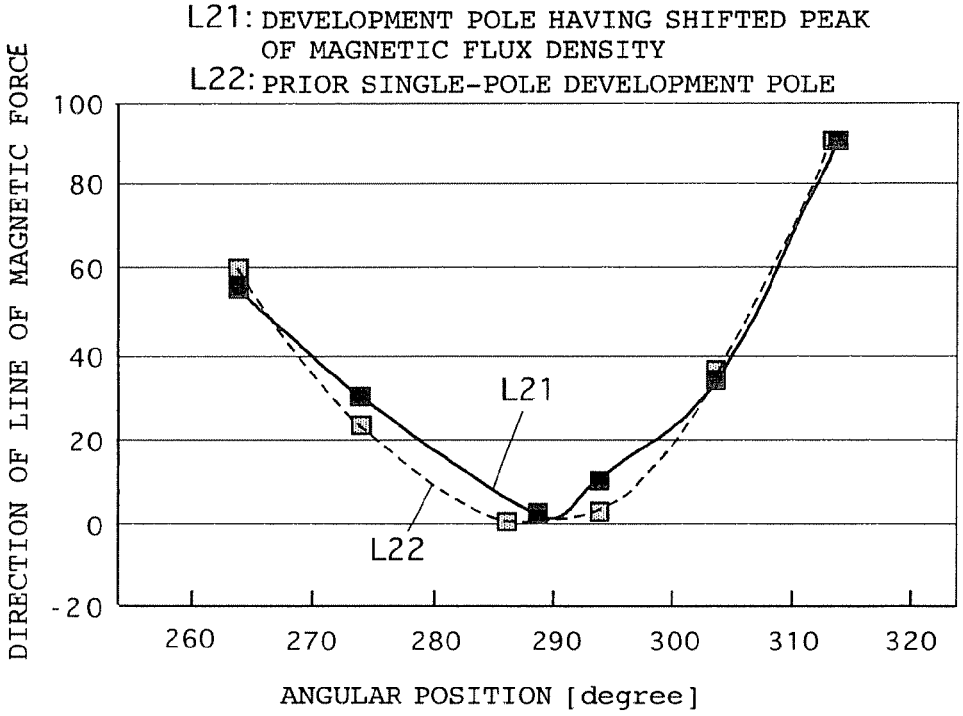
FIG. 12 is a drawing which shows an example of the changes in the direction of lines of magnetic force produced by a known single-pole development pole and the development pole of the magnet body of the developing device of FIG. 2, respectively.

FIG. 11 shows an example of the changes in the magnetic force vectors produced by a known single-pole development pole and the development pole Dp of the magnet body 42, respectively. The peak values of the magnetic flux densities Br of these development poles in the normal direction are almost equal. FIG. 12 shows an example of the changes in the direction of lines of magnetic force caused by the same known single-pole development pole as in the case of FIG. 11 and the same development pole Dp of the magnet body 42 as in the case of FIG. 11, respectively. As can be seen from FIGS. 11 and 12, the directions of lines of magnetic forces are almost equal in the two types of the development poles (refer to FIG. 12), and the development pole Dp of the magnet body 42 has a smaller magnitude of the magnetic force vector in the upstream portion in the development pole than that of the other.

In FIG. 12, the numerical value on the vertical axis represents the angle [degree], and the value "0" represents the normal direction.

Figure 13:
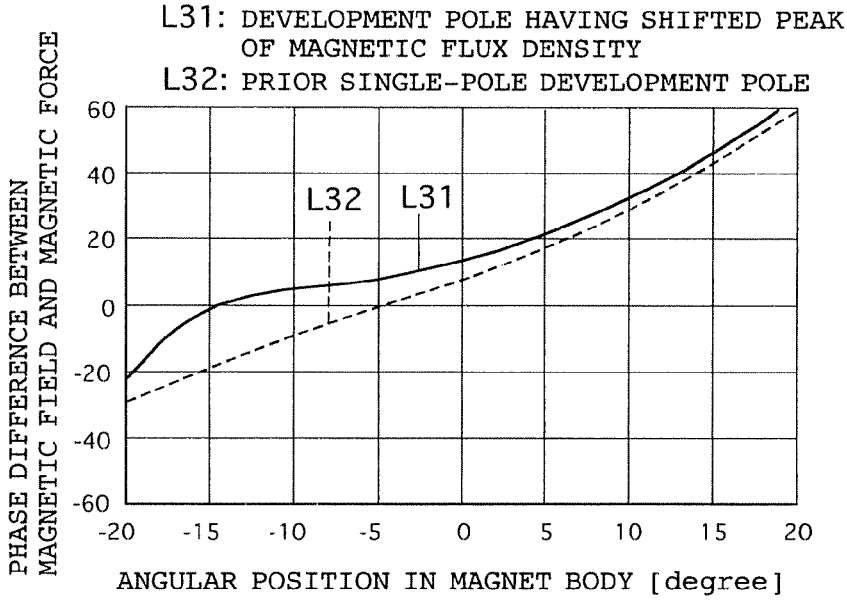
FIG. 13 is a drawing which shows the phase differences between magnetic field and magnetic force produced by a known single-pole development pole and the development pole of the magnet body of the developing device of FIG. 2, respectively.

FIG. 13 shows the phase differences between the magnetic fields and the magnetic forces produced by the known single-pole development pole and the development pole Dp of the magnet body 42 which have almost equal peak values of the magnetic flux density Br in the normal direction, respectively.

The "0" position of the horizontal axis in FIG. 13 is the position P1 of the development pole Dp, and the "0" on the vertical axis represents the direction along the normal of the development sleeve, where inclination $\beta$=inclination $\alpha$ is held in FIG. 14, which will be described later.

As can be seen from FIG. 13, as the development pole Dp of the magnet body 42 in which the peak value Brp has been shifted downstream in the direction of movement of the surface of the photosensitive member, in case of a development pole where the direction of lines of magnetic force in the upstream portion in the direction of movement of the surface of the photosensitive member in the development pole is substantially unchanged and the magnitude of the vector of the magnetic force in the upstream portion becomes smaller, there is substantially no phase difference between the magnetic force and the magnetic field in the upstream portion of the development pole as compared with the prior same-pole development pole.

As a result, inclination of the magnetic brushes (especially carrier particle chains) with respect to the direction of the normal of the surface of the development sleeve 41 is reduced. That is, the state that the magnetic brushes are upright in the direction of the normal with respect to the surface of the development sleeve 41 can be maintained in a larger range within the development region Da.

Figure 14A:
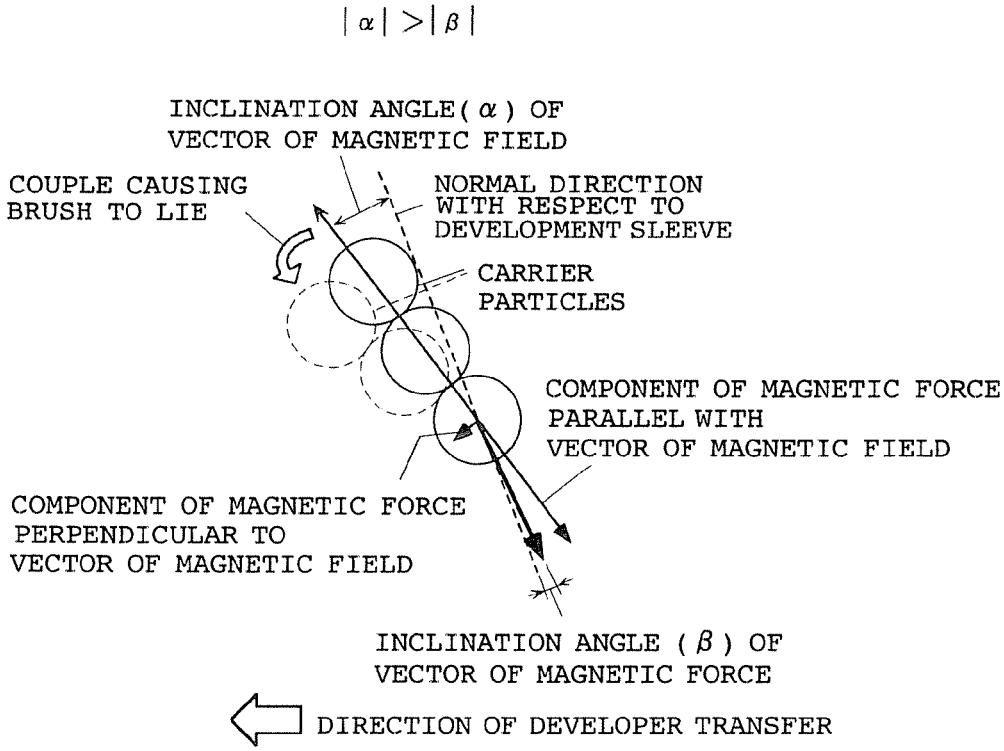
FIGS. 14(A) and 14(B) are drawings which illustrate the couple (couple of forces) applied to the magnetic brushes.
Figure 14B:
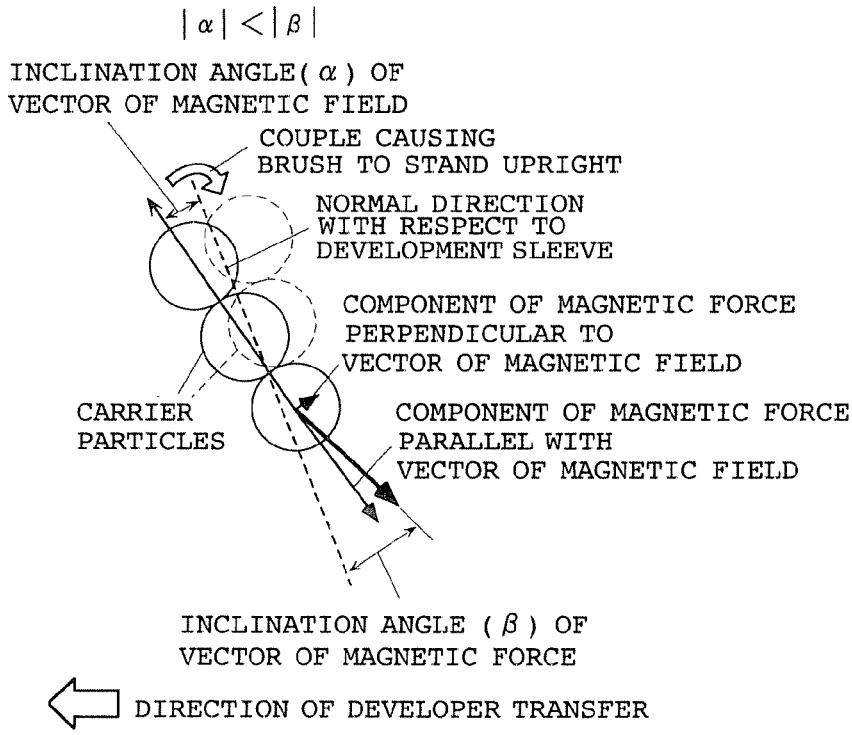

FIGS. 14(A) and 14(B) illustrate this. In a state that the phase difference is small, as shown in FIG. 14(A), the relationship between inclination $\alpha$ of the magnetic field vector with respect to the direction of the normal of the development sleeve and inclination f of the magnetic force vector with respect to the direction of the normal of the development sleeve becomes $|\alpha|>|\beta|$. The couple (couple produced by a magnetic force component perpendicular to the magnetic field vector) which causes the brushes (magnetic brushes) to lie flat is produced.

Meanwhile, when the phase difference is great, as shown in FIG. 14(B), the relationship between inclination $\alpha$ and inclination $\beta$ becomes $|\alpha|<|\beta|$, and the couple which causes the brushes (magnetic brushes) to stand upright is produced. Since the couple which causes the magnetic brushes to stand upright is produced in this manner, it is more likely that the magnetic brushes formed by the upstream portion in the direction of movement of the surface of the photosensitive member in the development pole Dp rub the photosensitive member 1 in a state that the brushes are upright.

Moreover, an upstream portion of the development pole Dp in which the magnitude of the magnetic force vector has been reduced in such a manner can be set over a large width in the development pole in the direction of transfer of the developer, and the developer facing the upstream portion over the large width can be retained on the development sleeve in the form of a number of thin magnetic brushes with low magnetic force, and therefore in a state that the mobility of the carrier particles is increased.

Figure 15:
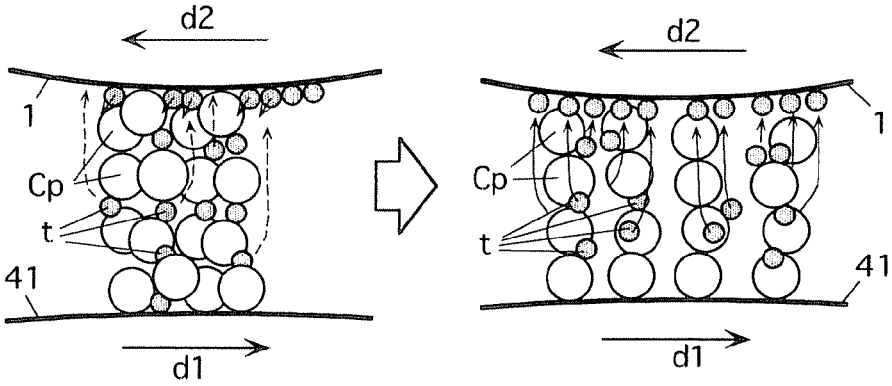
FIG. 15 is a drawing which schematically shows known thick and short magnetic brushes and thin magnetic brushes which are formed in a large number.
Figure 20A:
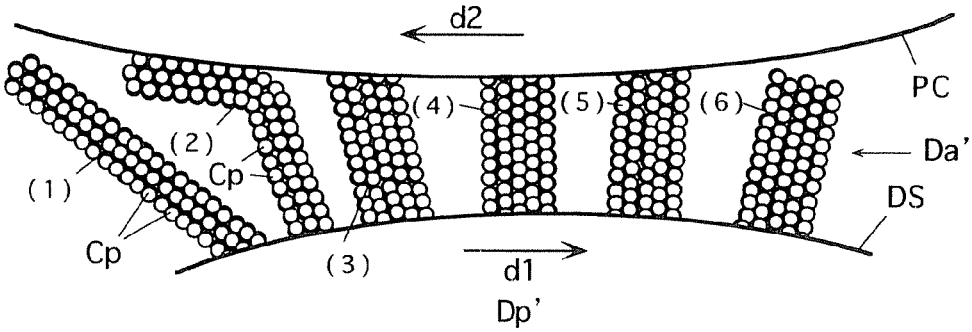
FIG. 20(A) is a drawing which schematically shows an example of developer brushes (magnetic brushes) formed by a known development pole.
Figure 20B:
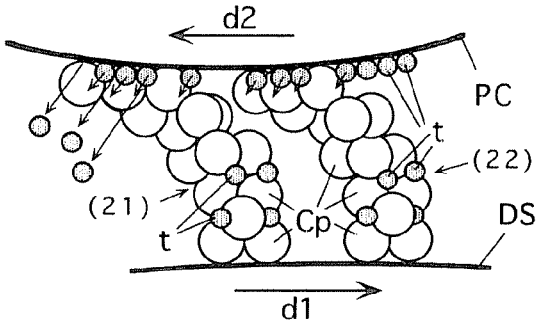
FIG. 20(B) is an expanded view which schematically shows long magnetic brushes.
Figure 20C:
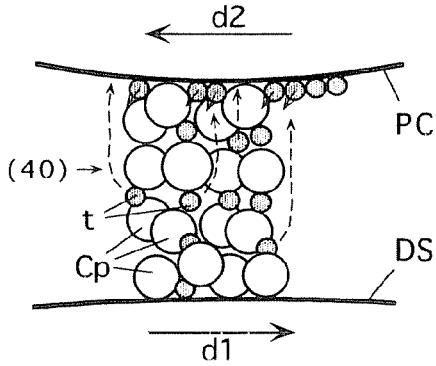
FIG. 20(C) is an expanded view which schematically shows thick and short magnetic brushes.
Figure 21A:
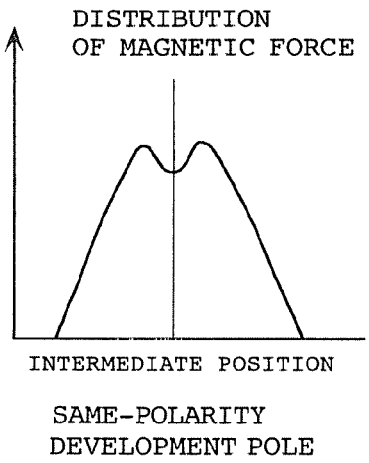
FIG. 21(A) is a drawing which shows an example of the distribution of magnetic force of a known same-polarity development pole.
Figure 21B:
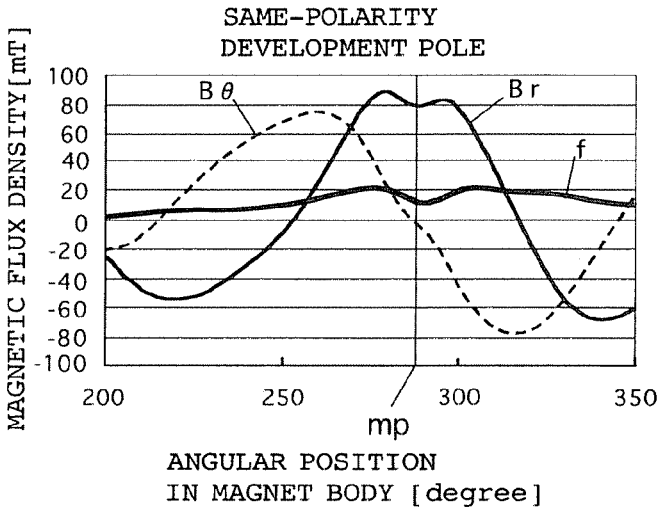
FIG. 21(B) is a drawing which shows an example of the distributions of magnetic flux densities produced by the same-polarity development pole.

The force for constraining toner in those magnetic brushes is lowered than in the case of the thick and short magnetic brushes [magnetic brushes in the same state as the known thick, hard and short magnetic brushes shown in FIG. 20(C) as an example] shown to the left in FIG. 15, and the transference of the toner t to the electrostatic latent image is made proportionally easier. Furthermore, since the brushes are soft and short, they do not scrape off the toner of the toner image formed by development or disturb the toner image.

The drawing shown to the right in FIG. 15 schematically shows numerous thin and soft magnetic brushes formed in a state that the mobility of the carrier particles Cp is increased in such a manner, and schematically shows that the transference of the toner t is easy in the magnetic brushes.

In FIG. 15, d1 represents the direction of movement of the surface of the development sleeve 41 in the development region (the direction of transfer of the developer), and d2 represents the direction of movement of the surface of the photosensitive member 1 in the development region.

Figure 19A:
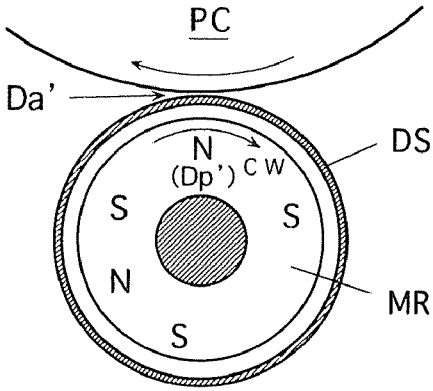
FIG. 19(A) is a drawing which shows an example of a magnet body and a development sleeve fitted onto the same in a known developing device.
Figure 19B:
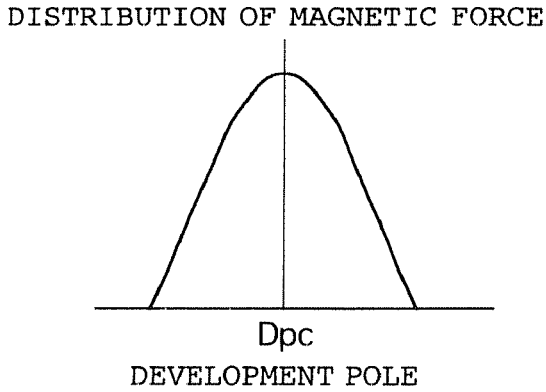
FIG. 19(B) is a drawing which shows an example of the distribution of magnetic force of the development pole composed of a single magnetic pole.

Hence, the efficiency of development can be improved than in the case where the development pole is formed of a single magnetic pole so that the distribution of the magnetic force of the development pole is made substantially symmetrical with respect to the center of the development pole as shown in FIG. 19(B), and the efficiency of development can be comparably improved than in the case where the same-polarity development pole is employed. In addition, since the development pole Dp consisting of a single magnetic pole is employed, the disturbance of the developer in the development region Da is suppressed than in the case where the same-polarity development pole is employed, and the generation of the fogging phenomenon can be suppressed proportionally better, and at the same time the efficiency of development can be improved.

Figure 16:
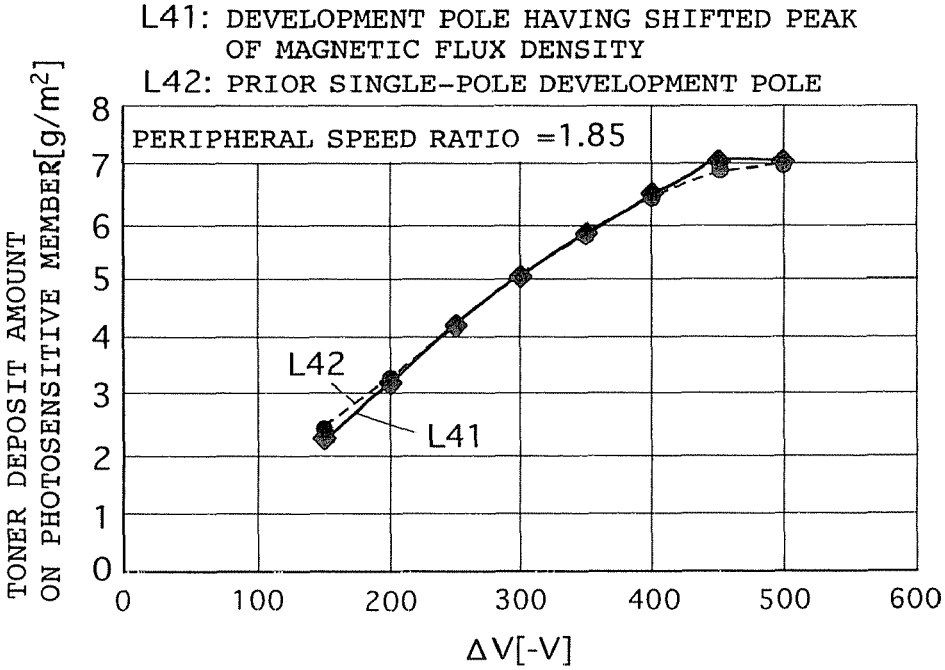
FIG. 16 is a drawing which shows the amounts of the toner deposited to the photosensitive member (in other words development efficiency) by a known same-polarity development pole and the development pole of the magnet body of the developing device of FIG. 2, respectively.

FIG. 16 shows the result of measurement of the amount of the toner deposited onto the photosensitive member by developing and forming a toner image having the highest toner density on the photosensitive member 1 by using each of a developing device employing a magnet body having a known same-polarity development pole and a developing device employing the magnet body 42 having the development pole Dp in which the peak value of the magnetic flux density in the normal direction is shifted downstream in the direction of movement of the surface of the photosensitive member.

Figure 17:
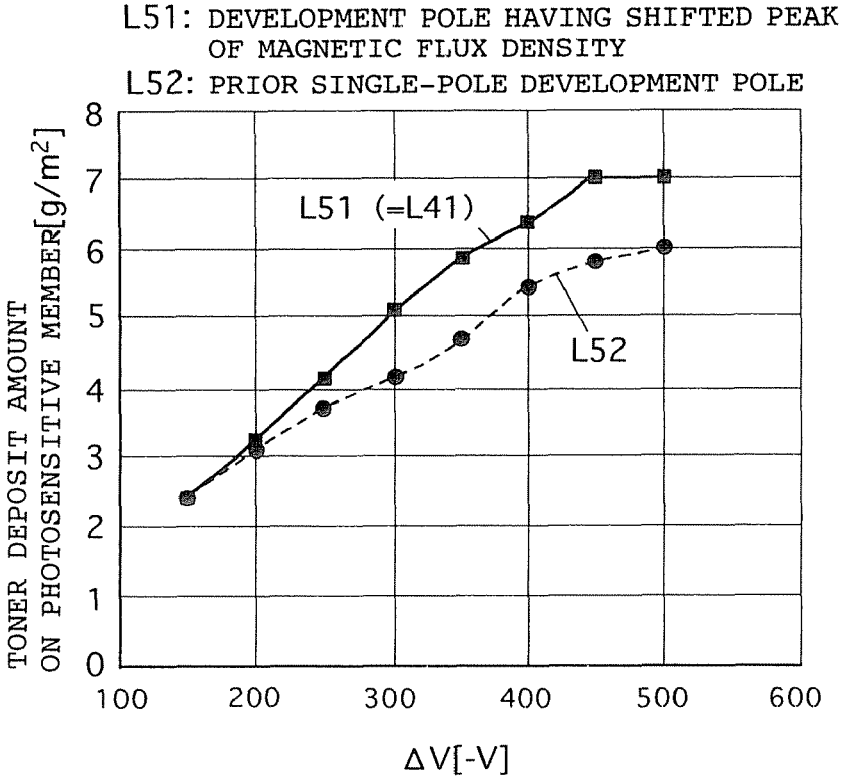
FIG. 17 is a drawing which shows the amounts of the toner deposited to the photosensitive member (in other words, development efficiency) by a known singles pole development pole and the development pole of the magnet body of the developing device of FIG. 2, respectively.

FIG. 17 shows the result of measurement of the amount of the toner deposited onto the photosensitive member by developing and forming a toner image having the highest toner density on the photosensitive member 1 by using each of a developing device employing a magnet body having a known single-pole development pole and a developing device employing the magnet body 42 having the development pole Dp in which the peak value of the magnetic flux density in the normal direction is shifted downstream in the direction of movement of the surface of the photosensitive member.

In both cases of FIGS. 16 and 17, the magnetic flux densities in the normal direction of a single magnetized portion in the development pole in both developing devices were the same (100 mT), and the constitutions of the developing devices other than the development pole and the development conditions were substantially the same.

The direction of movement of the surface of the development sleeve in the development region and the direction of movement of the surface of the photosensitive member were opposite to each other, and the ratio θ of the peripheral speed of the sleeve to the peripheral speed of the photosensitive member was 1.85.

In FIGS. 16 and 17, the horizontal axis is a difference in potential between the surface of the photosensitive member and development sleeve for developing electrostatic latent images.

It can be seen from FIG. 16 that by employing the development pole Dp of the magnet body 42, the efficiency of development can be comparably improved than in the case of the electrostatic latent image development by the same-polarity development pole.

It can be seen from FIG. 17 that by employing the development pole Dp of the magnet body 42, development efficiency is improved compared to the case of the electrostatic latent image development by a conventional type of single-pole development pole.

In the developing device 4, as already mentioned, the height of the brushes (magnetic brushes) of the developer transferred to the development region Da is controlled by a brush height controlling member 43. Clogging may occur in such a controlling member, and a stripe-like image noise may be generated when clogging occurs. However, in the developing device 4, an upstream portion of the development pole Dp in the direction of movement of the surface of the photosensitive member corresponds to the Y region in FIG. 8.

The magnetic brushes formed by the upstream portion of the development pole Dp have a high degree of freedom due to its low magnetic attraction force f as already mentioned, and are in the form of numerous thin magnetic brushes as shown in the right drawing in FIG. 15. These magnetic brushes have low force of constraining the toner, thereby giving good toner mobility.

Accordingly, the portion having the stripe-like pattern due to deficiency of the toner which may be generated by clogging in the controlling member 43 are likely to be filled up with the toner having high mobility, and generation of stripe-patterned image noise by clogging in the controlling member is proportionally suppressed.

By employing the development pole Dp of the magnet body 42, deposition of the carrier particles Cp to the electrostatic latent image carrier (the photosensitive member 1 herein) can be suppressed more than in the case where the central portion between the same-polarity magnetized portions at the same-polarity development pole is set at a position where the developer leaves from the electrostatic latent image carrier, and the efficiency of development can be improved at the same time since it is a development pole consisting of a single magnetic pole and therefore the disturbance of the developer is suppressed compared to the same-polarity development pole.

The direction of movement of the surface of the development sleeve in the development region (therefore the direction of transfer of the developer) and the direction of movement of the surface of the electrostatic latent image carrier may be the same. However, in the printer PR shown in FIG. 1, as shown in FIG. 2, the rotational directions the development sleeve 41 and the electrostatic latent image carrier 1 are both the clockwise direction CW, and therefore the direction of movement of the surface of the development sleeve 41 in the development region Da and the direction of movement of the surface of the image carrier 1 are opposite to each other.

Since the direction of movement of the surface of the development sleeve 41 and the direction of movement of the surface of the image carrier 1 are thus opposite to each other, the carrier particles Cp which may be deposited from the highly mobile magnetic brushes of the carrier particles formed by the downstream portion in the direction of transfer of the developer in the development pole Dp (refer to the drawing to the right in FIG. 15) to the image carrier 1 are captured by the magnetic brushes having low mobility carrier particles formed by the upstream portion in the development pole Dp, and therefore the development efficiency can be improved as a whole while deposition of the carrier particles to the image carrier 1 can be suppressed.

In the development pole Dp of the magnet body 42 of the developing device 4, as shown in FIG. 8, the angular positions p3, p4 which indicate the magnetic flux densities of a predetermined proportion of the peak value Brp of the density of magnetic flux are the positions which are spaced from the angular position p1 which indicates the peak value Brp to the upstream side and downstream side, respectively, in the direction of transfer of the developer, by equal central angles. Herein, although the value 50% is shown in FIG. 8 as the "predetermined proportion of the peak value Brp", the proportion is not limited to 50%.

However, too low a proportion reduces the affected area, while too high a proportion makes the P1 position too far from the development region, which makes the carrier particles deposited to the photosensitive member more easily. Therefore, the proportion may be, for example, about 25% to 75%. A permissible range of this proportion is generally determined by the balance between the diameter of the photosensitive member and the diameter of the magnet body. The larger the diameter of the photosensitive member, the wider the permissible range of the proportion, while on the other hand the smaller the diameter of the photosensitive member, the narrower the permissible range of the proportion.

By increasing the magnetic flux density Bθ in the tangent direction of the surface of the development sleeve 41 and increasing the magnetic attraction force f at the point where the developer leaves the photosensitive member 1, deposition of the carrier particles to the photosensitive member 1 can be suppressed, and at the same time the height of the chains of the carrier particles can be limited to a low level so that a scratch in the toner image on the photosensitive member 1 by the chains and lowered image quality due to the scratch can be suppressed.

From this perspective, regarding the magnetic pole which is adjacent to the development pole Dp of the magnet body 42 downstream in the direction of movement of the surface of the photosensitive member, the following case can be given as an example: the magnetic flux density in the normal direction with respect to the surface of the development sleeve 41 produced by the adjacent magnetic pole is set to about 60 mT to 100 mT. Moreover, the following case can be given as an example: the distance between the development pole Dp and the adjacent magnetic pole is the angular interval between the centers of the magnetic poles, which is set to about 15 to 45 degrees. However, the relationship between the development pole Dp and the magnetic pole adjacent upstream thereof is not limited to this one.

Referring to the developer used, it is preferable that the magnetic brushes (especially their carrier particle chains) formed by an upstream portion of the development pole Dp in the direction of movement of the surface of the photosensitive member are thin and numerous (the density is high) for facilitating the transference of the toner t and improving the efficiency of development, as in the right drawing in FIG. 15. From this perspective, the particle size of the carrier particles Cp of about 40 μm or smaller can be given as an example. However, it is preferable that the particle size is typically 20 μm or larger to make the particles function as the carrier particles.

Moreover, the magnetic force of the carrier particles Cp of about 80 emu/g or lower can be given as an example, for the purpose of suppressing the generation of blurring in the toner image formed on the image carrier 1 caused by being scratched by the magnetic brushes, maintaining the granularity of the carrier particles, and sweeping up the carrier particles together. However, it is preferable that the magnetic force of the carrier particles Cp is typically about 20 emu/g or larger to make the particles function as the magnetic carrier particles.

Therefore, it is preferable that the carrier particles Cp of the developer used have a particle size in a range from 20 μm to 40 μm, and that they have a magnetic force in a range from 20 emu/g to 80 emu/g. However, the particle size and magnetic force are not limited to these ranges.

Referring further to the developer, from the perspective of suppressing the generation of image defects due to an excessive increase in the height of the magnetic brushes, which causes the toner image on the photosensitive member 1 to be strongly rubbed by the brushes, and increasing the release property of the toner to improve the image quality, the magnetic carrier particles Cp can be spherical carrier particles, and the toner t can be a spherical toner.

From the perspective of reducing a load applied to the rotation of the development sleeve 41 by the developer and suppressing the deterioration of the developer and toner scattering, the ratio of the peripheral speed of the development sleeve 41 to the peripheral speed of the electrostatic latent image carrier (the photosensitive member 1 herein) in a range from 1.0 to 2.2 can be given as an example.

From the perspective of reducing the size of the photosensitive member 1 for compactification of and reducing the size of the image forming apparatus and reducing the size of the photosensitive member 1 while improving the development efficiency at the same time, the case where the outer diameter of the photosensitive member 1 is about 20 mm to 60 mm, and the outer diameter of the development sleeve 41 of the developing device is about 10 mm to 30 mm can be given as an example.

The magnet body 42 will be now described again. As shown in FIGS. 6 and 18(A), the above-described magnet body 42 is in its entirety, including the development pole Dp, composed of a ferrite-based magnet, but the magnet bodies shown in FIGS. 18(B) to 18(G) as examples and others can be also employed.

Each of these magnet bodies have the development pole Dp with the cutout portion Ct upstream of the center of the development pole in the development region in the direction of movement of the surface of the photosensitive member 1, and shows the distribution of magnetic flux density in the normal direction as in FIG. 8.

Figure 18B:
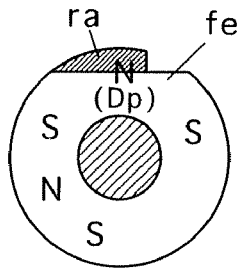
Figure 18C:
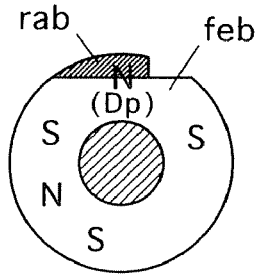

Each magnet body in FIGS. 18(A) to 18(C) is such that is integrally molded in its entirety, and each magnet body in FIGS. 18(D) to 18(G) is constituted by magnet members combined annularly, each of which has a magnetic pole and a general fan sectional shape.

Figure 18D:
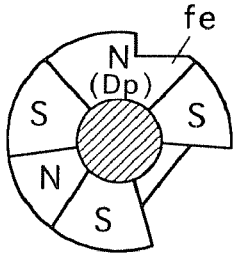

Each part of the magnet body in FIG. 18(D) including the development pole Dp is constituted by the ferrite-based magnet fe.

Figure 18E:
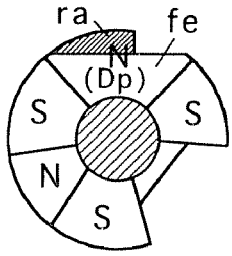
Figure 18F:
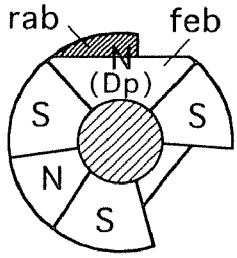
Figure 18G:
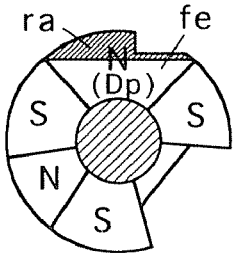

The development pole Dp of the magnet body in each of FIGS. 18(B), 18(E) and 18(G) is constituted by a rare earth-based magnet ra and the ferrite-based magnet fe. The rest of the magnetic pole portion is constituted by the ferrite-based magnet fe. In the development pole of the magnet body in FIG. 18(G), the rare earth-based magnet ra portion is extending upstream in the direction of movement of the surface of the photosensitive member 1 in the development region, and the cutout portion Ct is formed in that portion.

Thus, in the magnet body where the development pole is constituted by the rare earth-based magnet ra and ferrite-based magnet fe and the rare earth-based magnet ra is positioned mainly downstream in the direction of movement of the surface of the photosensitive member, a sufficient difference in magnetic force can be obtained between the upstream portion and the downstream portion in the direction of movement of the surface of the photosensitive member in the development pole, whereby the magnitude of the magnetic force vector by the upstream portion can be reduced, and the couple which causes the carrier particle chains to stand upright can be obtained more reliably than in the magnet bodies in FIGS. 18(A) and 18(D).

In the magnet body in each of FIGS. 18(C) and 18(F), the development pole Dp is constituted by a bonded magnet rab containing a rare earth-based magnetic powder and a bonded magnet feb containing a ferrite-based magnetic powder, and the bonded magnet rab containing a rare earth-based magnetic powder is positioned downstream in the direction of movement of the surface of the photosensitive member.

In these magnet bodies, as in the magnet bodies in FIGS. 18(B), 18(E) and 18(G), a sufficient difference in magnetic force between the upstream portion and downstream portion in the development pole can be obtained. Accordingly, the magnitude of the magnetic force vector by the upstream portion can be reduced, and the couple which causes the carrier particle chains to stand upright can be obtained more reliably than in the magnet bodies in FIGS. 18 (A) and 18 (D).

Although the printer described above is a tandem-type full-color printer, the present invention can be also applied to monochrome image forming apparatuses and other types of multi-color image forming apparatuses (for example, so-called four-cycle type full-color printers) and the like. Moreover, in an image forming apparatus having a plurality of developing devices, the present invention may only be applied to a fewer number of developing devices than the total number of the developing devices.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing device comprising a fixedly disposed magnet body, and a development sleeve which is rotatably fitted onto the magnet body, the developing device forming and retaining developer brushes comprising a developer containing a toner and magnetic carrier particles on a surface of the development sleeve by a magnetic force of the magnet body, transferring the developer brushes to a development region in which an electrostatic latent image formed on a surface of an electrostatic latent image carrier which is rotationally driven is developed, and bringing the developer brushes into contact with the surface of the electrostatic latent image carrier to develop the electrostatic latent image, wherein the magnet body has a group of annularly arranged magnetic poles comprising a development pole which is a single magnetic pole facing the development region;

an angular position which indicates a peak value of a magnetic flux density in a normal direction with respect to the surface of the development sleeve produced by the development pole in the magnet body is shifted downstream from an angular position of a center of the development pole in the magnet body in the development region in a direction of movement of the surface of the electrostatic latent image carrier opposing the development sleeve;

angular positions which indicate a magnetic flux density of a predetermined proportion of the peak value of the magnetic flux density in the magnet body are positions which are spaced at equal angular intervals upstream and downstream in the direction of movement of the surface of the electrostatic latent image carrier; and the relationship between an angle X from the angular position in the magnet body which indicates the peak value of the magnetic flux density to a position which is downstream of the angular position indicating the peak value and in which the magnetic flux density in the normal direction becomes 0 in the direction of movement of the surface of the electrostatic latent image carrier and an angle Y from the angular position indicating the peak value to a position which is upstream of the angular position indicating the peak value and in which the magnetic flux density in the normal direction becomes 0 is $Y>X$.

2. The developing device according to claim 1, wherein a change in the magnetic flux density from the angular position which indicates the peak value of the magnetic flux density to the position where the magnetic flux density in the normal direction on the upstream side in the direction of movement of the surface of the electrostatic latent image carrier becomes 0 comprises a point of inflection between the position which indicates the magnetic flux density of the predetermined proportion of the peak value of the magnetic flux density on the upstream side and the position where the magnetic flux density in the normal direction becomes 0.

3. The developing device according to claim 1, wherein the magnetic flux density of the predetermined proportion of the peak value of the magnetic flux density is a magnetic flux density ranging from 25% to 75% of the peak value of the magnetic flux density.

4. The developing device according to claim 1, wherein the development pole of the magnet body has a cutout portion upstream of the development pole center in the direction of movement of the surface of the electrostatic latent image carrier.

5. The developing device according to claim 1, wherein the development pole of the magnet body is constituted by a rare earth-based magnet and a ferrite-based magnet, and the rare earth-based magnet is positioned mainly downstream in the direction of movement of the surface of the electrostatic latent image carrier.

6. The developing device according to claim 1, wherein the development pole of the magnet body is constituted by a bonded magnet containing a rare earth-based magnetic powder and a bonded magnet containing a ferrite-based magnetic powder, and the bonded magnet containing the rare earth-based magnetic powder is positioned mainly downstream in the direction of movement of the surface of the electrostatic latent image carrier.

7. The developing device according to claim 1, wherein in the magnet body, the magnetic flux density in the normal direction with respect to the surface of the development sleeve produced by a magnetic pole which is adjacent downstream to the development pole in the direction of movement of the surface of the electrostatic latent image carrier is in a range from 60 mT to 100 mT, and an angular interval between the center of the magnetic pole which is adjacent downstream to the development pole and the center of the development pole is in a range from 15 degrees to 45 degrees.

8. The developing device according to claim 1, wherein the carrier particles of the developer have a particle size ranging from 20 μm to 40 μm, and a magnetic force ranging from 20 emu/g to 80 emu/g.

9. The developing device according to claim 1, wherein the magnetic carrier particles in the developer are spherical carrier particles, and the toner is a spherical toner.

10. An image forming apparatus comprising a developing device according to claim 1, the device being capable of developing an electrostatic latent image formed on an electrostatic latent image carrier which is rotationally driven and forming a toner image by the developing device.

11. The image forming apparatus according to claim 10, wherein in a development region in which the electrostatic latent image on the electrostatic latent image carrier is developed, a direction of movement of a surface of the electrostatic latent image carrier is opposite to the direction of movement of the surface of the development sleeve of the developing device.

12. The image forming apparatus according to claim 10, wherein a ratio of a peripheral speed of the development sleeve of the developing device to a peripheral speed of the electrostatic latent image carrier is in a range from 1.0 to 2.2.

13. The image forming apparatus according to claim 10, wherein the electrostatic latent image carrier is a drum type photosensitive member; the outer diameter of the photosensitive member is 20 mm to 60 mm; and the outer diameter of the development sleeve of the developing device is 10 mm to 30 mm.

14. An image forming apparatus comprising a developing device according to claim 2, the device being capable of developing an electrostatic latent image formed on an electrostatic latent image carrier which is rotationally driven and forming a toner image by the developing device.

15. An image forming apparatus comprising a developing device according to claim 3, the device being capable of developing an electrostatic latent image formed on an electrostatic latent image carrier which is rotationally driven and forming a toner image by the developing device.

16. An image forming apparatus comprising a developing device according to claim 4, the device being capable of developing an electrostatic latent image formed on an electrostatic latent image carrier which is rotationally driven and forming a toner image by the developing device.

17. An image forming apparatus comprising a developing device according to claim 5, the device being capable of developing an electrostatic latent image formed on an electrostatic latent image carrier which is rotationally driven and forming a toner image by the developing device.

18. An image forming apparatus comprising a developing device according to claim 6, the device being capable of developing an electrostatic latent image formed on an electrostatic latent image carrier which is rotationally driven and forming a toner image by the developing device.

19. An image forming apparatus comprising a developing device according to claim 7, the device being capable of developing an electrostatic latent image formed on an electrostatic latent image carrier which is rotationally driven and forming a toner image by the developing device.

20. An image forming apparatus comprising a developing device according to claim 8, the device being capable of developing an electrostatic latent image formed on an electrostatic latent image carrier which is rotationally driven and forming a toner image by the developing device.

* * * * *